US007743935B2

(12) United States Patent
Maid

(10) Patent No.: US 7,743,935 B2
(45) Date of Patent: Jun. 29, 2010

(54) LOCK BOX

(76) Inventor: Randy R. Maid, 4103 La Veta Dr., Loveland, CO (US) 80538

( * ) Notice: Subject to any disclaimer, the term of this patent is extended or adjusted under 35 U.S.C. 154(b) by 852 days.

(21) Appl. No.: 11/639,509

(22) Filed: Dec. 15, 2006

(65) Prior Publication Data

US 2008/0142522 A1 Jun. 19, 2008

(51) Int. Cl.
*B65D 45/16* (2006.01)
*B65D 55/02* (2006.01)
*B65D 43/16* (2006.01)

(52) U.S. Cl. ..... 220/210; 70/84; 70/159; 220/326; 220/835; 232/41 D

(58) Field of Classification Search ..... 220/210, 220/476, 326, 324, 835; 70/84, 159, 162, 70/286; 232/41 D
See application file for complete search history.

(56) References Cited

U.S. PATENT DOCUMENTS

| | | | | |
|---|---|---|---|---|
| 975,455 | A | 11/1910 | Prevost | |
| 1,046,784 | A * | 12/1912 | Hartman | 232/41 D |
| 1,110,779 | A | 9/1915 | Hartman | |
| 1,219,360 | A | 3/1917 | Storms | |
| 4,382,540 | A * | 5/1983 | Kelly et al. | 232/17 |
| 5,476,220 | A * | 12/1995 | Cohoon | 232/17 |
| 6,412,688 | B1 * | 7/2002 | Tucker et al. | 232/45 |

* cited by examiner

*Primary Examiner*—Anthony Stashick
*Assistant Examiner*—Niki M Eloshway
(74) *Attorney, Agent, or Firm*—Craig R. Miles; CR Miles, P.C.

(57) ABSTRACT

A self locking enclosure and method of self locking an enclosure which provides an enclosure having a hingedly coupled lid which locks by operation of a latch which allows a first occurrence of the lid in the closed condition and subsequent operation of the lid to the open condition and which locks upon the second occurrence of the lid in the closed condition.

11 Claims, 5 Drawing Sheets

LOCK BOX

I. BACKGROUND

A self locking enclosure and method of self locking an enclosure which provides an enclosure having a hingedly coupled lid which locks by operation of a latch which allows a first occurrence of the lid in the closed condition and subsequent operation of the lid to the open condition and which locks upon the second occurrence of the lid in the closed condition.

A variety of conventional lock boxes allow a locked access panel to be opened for placement of objects inside the lock box. See for example U.S. Pat. Nos. 975,455; 1,110,779; or 1,219,360. The lock box is subsequently unlocked and the object placed inside the lock box retrieved by the recipient of the object.

A significant problem with conventional lock boxes can be that the lock box must be unlocked to place the object in the lock box for delivery. This necessitates the person placing the object in the box to have possession of a key, code, combination, signal element, or other information which allows the locked panel to be unlocked for placement of the object in the lock box. One solution to this problem has been the use of a post office boxes or residential lock boxes to which the postal service employee has a form of access means. However, with the increased use of mail order or electronic sales (for example over the Internet) and the increased use of commercial carriers to deliver parcels to residences, many parcels are left in front of the residence outside of any secured area or in an unsecured enclosure.

Despite advances in the art of locked boxes in which objects can be placed, there remains a need for novel embodiments of lockable enclosures which can be opened without having possession of unlocking elements or means to unlock an access panel such as a key, combination, code, signal, or the like to allow placement of an object(s) within the lockable enclosure and then upon subsequent closure self lock.

II. SUMMARY OF THE INVENTION

Accordingly, a broad object of the invention can be to provide a self locking enclosure and method of self locking an enclosure which provides an enclosure having a hingedly coupled lid which allows a first occurrence of the lid in the closed condition without locking and subsequent operation of the lid to the open condition to allow placement of an object in the enclosure and which locks upon the second occurrence of the lid in the closed condition.

A second broad object of the invention can be to provide an embodiment of a self locking latch which can be utilized with or coupled to a variety of receptacles or containers to produce, or convert a conventional receptacle or container, to a self-locking container or receptacle.

Naturally, further objects of the invention are disclosed throughout other areas of the specification, drawings, photographs, and claims.

III. A BRIEF DESCRIPTION OF THE DRAWINGS

IV. DETAILED DESCRIPTION OF THE PREFERRED EMBODIMENTS

A self locking enclosure and method of self locking an enclosure which provides an enclosure having a hingedly coupled lid which locks by operation of a latch which allows a first occurrence of the lid in the closed condition and subsequent operation of the lid to the open condition and which locks upon the second occurrence of the lid in the closed condition.

Figures 1, 1A:
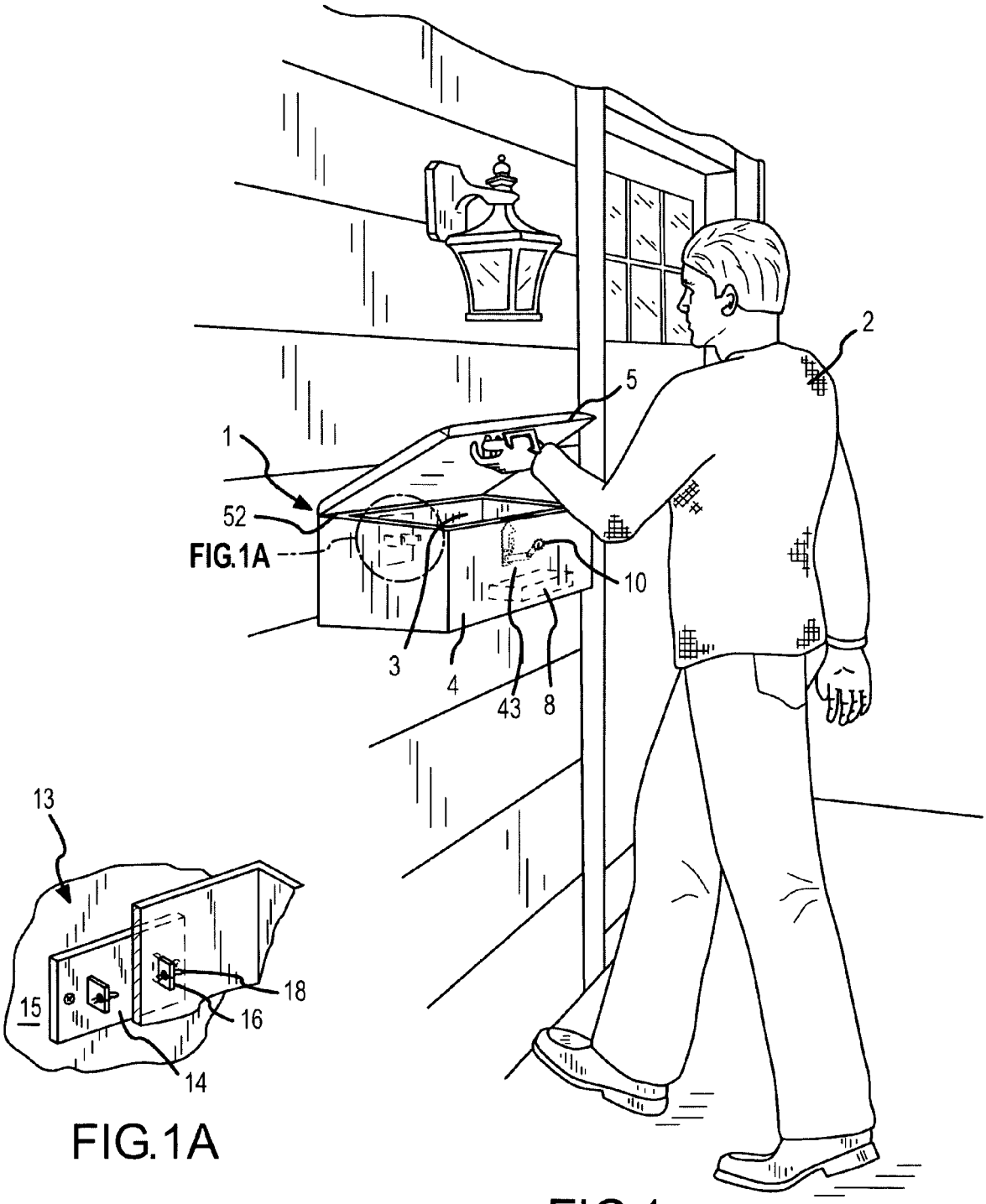
FIG. 1 is a perspective view which shows a method of using an inventive self locking enclosure.
FIG. 1A is a perspective view of an embodiment of an enclosure mount.

Now referring primarily to FIG. 1, a method of using an embodiment of the inventive self locking enclosure (1) is shown. A person (2) can obtain access to the inside (3) of a container (4) by operation of a hingedly coupled (52) lid (5) from the closed condition (6)(see FIG. 2) to the open condition (7)(see FIG. 3). In the open condition (7), the person (2) can place an object (8) inside (3) of the container (4). The lid (5) can be operated from the open condition (7) to the closed condition (6) which lockingly engages a latch (9)(see FIG. 4 for example) which under normal use prevents access to the inside (3) of the container (4) without further operation of the lock (10) to release the locked engagement (11) of the latch (9).

The term "person" broadly encompasses any human or part of any human, whether or not aided by or using any machine, device, or hardware. The term "obtain access" means generating any amount of travel of the lid hingedly coupled (52) to the container from the closed condition toward the open condition. The term "self locking" means operation of the latch (9) from an unlocked to the locked condition (locked engagement of the latch (9)) without participation of or manipulation by any person (2). The term "lockingly engaged" means engagement of mechanical parts which under normal use requires operation of a discrete lock to disengage the mechanical parts. The term "container" means any receptacle in which an object can be located. The term "lid" means any member which can be fitted to a container to generate an enclosed space. The term "hingedly coupled" means any manner of engagement between a first part relative to a second part which allows the first part to travel relative to the second part without the first part becoming disengaged from the second part and by way of example without limiting the forgoing includes a jointed or flexible device that connects two parts such as the container and the lid allowing rotation between them and by way of non-limiting example includes pivot hinges, continuous hinges, barrel hinges, butt hinges, tee hinges, a flexible sheet material, or the like. The term "object" means any amount of a material or substance regardless of configuration or composition which can be located inside of or within the container.

Figure 2:
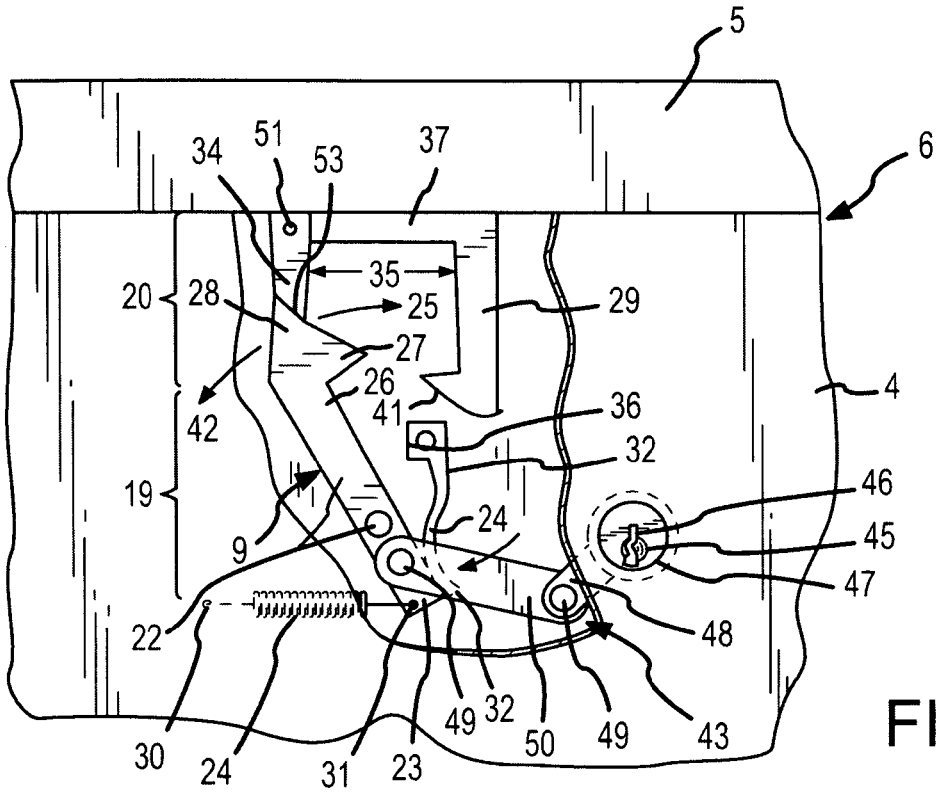
FIG. 2 is a front cutaway view of an embodiment of the self-locking enclosure with an embodiment of a latch positioned in the first occurrence of a lid in the closed condition.
Figure 3:
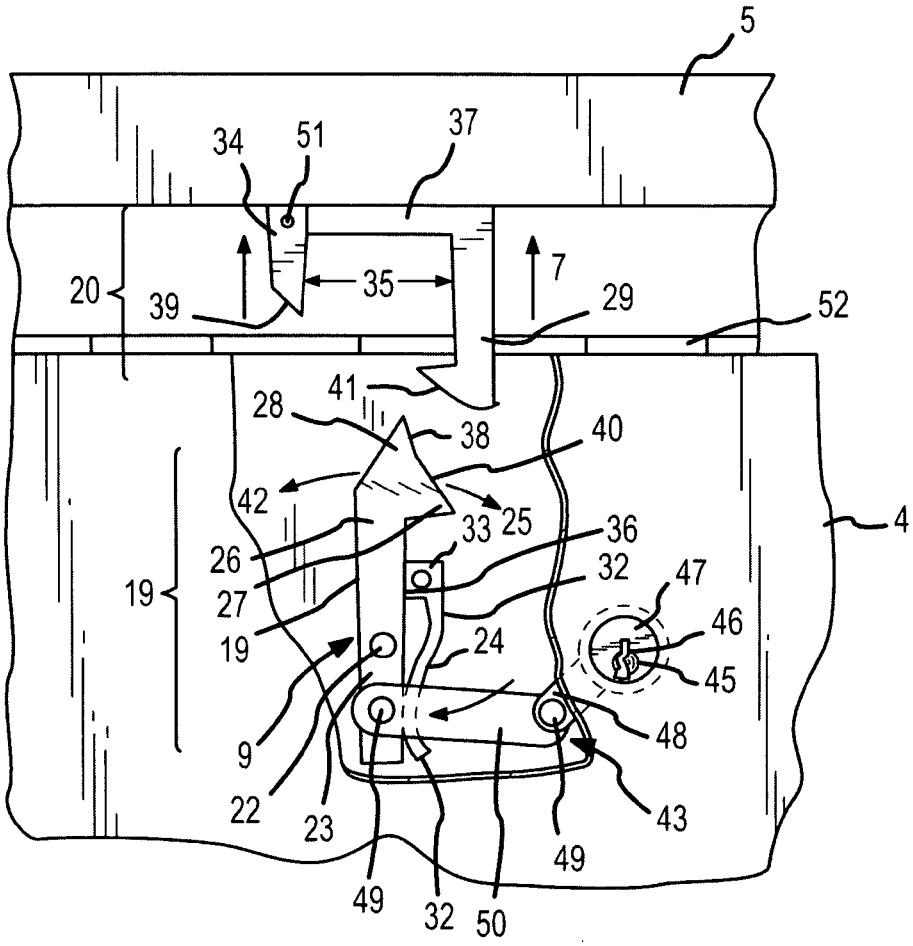
FIG. 3 is a front cutaway view of an embodiment of the self-locking enclosure with an embodiment of a latch positioned subsequent travel of the lid toward the open condition.

Again referring primarily to FIGS. 1, 2, and 3, embodiments of the inventive self locking enclosure (1) can include a container (4) as broadly defined above and as to particular embodiment of the invention shown by FIG. 1 can take the constructional form of a rectangular box. A lid (5) can be hingedly (52) coupled to the container (4) such that it operates between a closed condition (6)(as shown by FIG. 2) in which the lid (5) engages the container (4) to generate an enclosed space and an open condition (7)(as shown by FIGS. 1 and 3) in which the lid (5) travels a distance in the path defined by the hinged coupling to disengage in whole or in part from the container (4). It is not intended that the term open condition (7) limit the invention to a certain amount of travel and any amount of travel from the closed condition (6) can establish the open condition (7) of the lid (5).

The self locking enclosure can further include a enclosure mount (12)(shown in broken lines in FIG. 1 and enlarged in FIG. 1A) which can take any constructional form which operates to fix the container (4) at a location or operates to limit the travel of the container relative to the location (by a length of steel cord for example). A particular embodiment of the mount (12) as shown in FIG. 1A includes a bracket (13) having a mounting plate (14) which can be fixed to a surface (15) and at least one securement member (16) which projects outwardly from the mounting plate (14) to support the container (4) by way of penetrating the wall (17) of the container (4) and securing the container (4) to the at least one securement member (16) by mechanical hardware (18) such as clips, nuts having threads spirally mated to a portion of the at least one securement member (16), or otherwise.

Now referring primarily to FIGS. 2-8, embodiments of the self locking enclosure (1) can further include a latch (9) which can take one of a various constructional forms shown in the Figures or other similar or equivalent embodiments of the latch (9) which operate in accordance with the above-described method.

Figure 4:
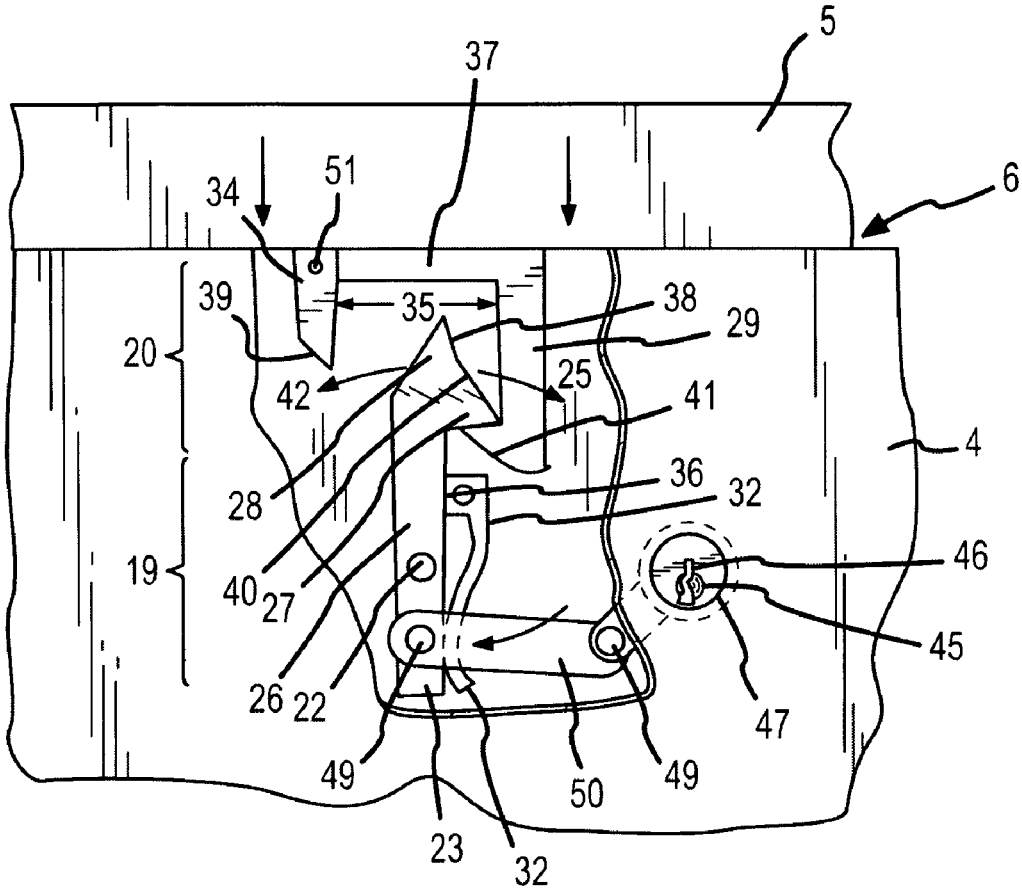
FIG. 4 is a front cutaway view of an embodiment of the self-locking enclosure with an embodiment of a latch positioned subsequent travel of the lid to the second occurrence of the the lid to the closed condition.
Figure 4A:
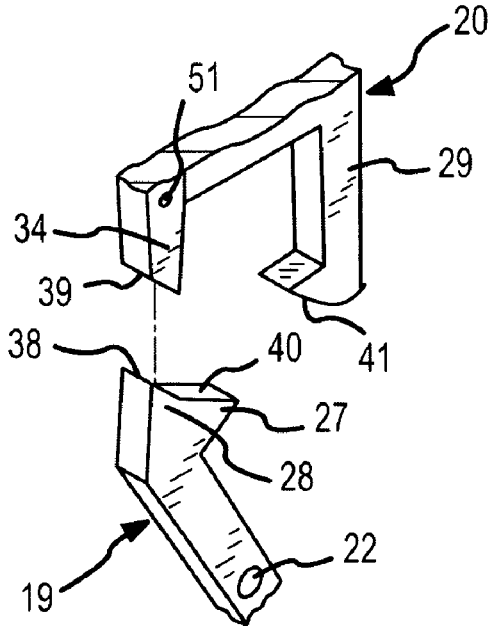
FIG. 4A is a perspective view of a portion of the embodiment of the latch shown by FIGS. 2-4.

As shown by FIGS. 2, 3 and 4, an embodiment of the latch (9) can comprise a first latch part (19) coupled to the container and a second latch part (20) coupled to the lid (5). The first latch part (19) can further include a latch member (21) which rotates about a pivot element (22) fixedly engaged to the container (4). The latch member (21) can include a first portion (23) responsive to a latch member rotation generation element (24) which generates directional rotation (25) (rotation in a first direction about the pivot element (22)) of a second portion (26) of said latch member (21) about the pivot element (22). The second portion (26) of the latch member (21) can further provide a latch element (27) and a projection element (28).

While the embodiment of the latch member (21) shown in FIGS. 2-4, can be produced from a sheet material having a thickness (for example metal or plastic sheet material having a thickness of between about one-sixteenth to about one-eighth inch), the invention is not so limited and any constructional form of the latch member (21) can be utilized which can be rotationally engaged with the pivot element (22) and made responsive to the latch member rotation generation element (24). Similarly, the latch member rotation generation element (24) can take any constructional form which functions to generate directional rotation (25) of the latch member (21) about the pivot element (22) in a first direction which allows the latch element (21) to engage a second extension element (29) and resists rotation of the latch member in the opposite direction about the pivot element (22). For example, a first embodiment of the latch member rotation generation element (24) can provide a coil spring (shown in hash marked lines in FIGS. 2-4) having a first coil spring end (30) connected to the container (4) and a second coil spring end (31) connected to the first portion (23) of the latch member (21). An amount of contraction of the coil spring (24) generates a corresponding amount of directional rotation (25) of the latch member (21) about the pivot element (22). As a second example, as shown in FIGS. 2-4, the latch member rotation generation element (24)(shown in solid object lines) include a flexibly resilient arm fixedly coupled to the container (4) proximate to a first arm end (32) and engaged with the first portion (23) of the latch member (21) proximate to the second arm end (33). The flexibly resilient arm (24) can have sufficient resilient flexure to forcibly urge the first portion (23) of the latch member (21) to rotate about the pivot element (22) in the first direction (25). It is not intended that these two examples of the latch member rotation generation element (24) limit the numerous and varied constructional forms of the latch member rotation generation element (24) suitable for use with the invention.

The second latch part (20) provides a first extension element (34) coupled to and extending outwardly from the lid (5) and the second extension element (29) coupled to and extending outwardly from the lid (5). The first extension element (34) and the second extension element (29) can be disposed a distance apart (35) as shown in FIGS. 2 and 3 such that the first extension element (34) and the projection element (28) of the second portion (26) of the latch member (21) can be configured to engage upon directional rotation (25) of the latch member (21) about said pivot element (22) upon a first occurrence of the lid (5) being established in the closed condition (6)(see for example FIG. 2 which shows the projection element (28) of the second portion (26) of the latch member (21) engaged with the first extension element (34)). The first extension element (34) and the projection element (28) can be further configured to allow disengagement upon operation of the lid (5) toward said open condition (7)(see for example FIG. 3 which shows the projection element (28) of the second portion (26) of the latch member (21) disengaged from the first extension element (34)) which allows further directional rotation (25) of the latch member (21) about the pivot element (22) to engage a stop element (36). As shown in FIG. 4, when the latch member (21) engages the stop element (36) the latch element (27) has a configuration capable of locked engagement with the second extension element (29) upon a second occurrence of the lid (5) in the closed condition (6).

The embodiment of the second latch part (20) shown by FIGS. 2-4 can be produced from a sheet material having a thickness (for example metal or plastic sheet material having a thickness of between about one-sixteenth to about one-eighth inch), although the invention is not so limited and can include a mount plate (37) to which the first extension element (34) and the second extension element (29) are coupled and extend. Although as to certain embodiments of the invention the first extension element (34) and the second extension element (29) can each be coupled directly to the lid (5) or the lid (5) and the first extension element (34) and the second extension element (29) can be produced as a single integral piece.

As shown primarily in FIGS. 2 and 3, the projection element (28) can further include a first projection element slide surface (38)(see FIG. 3) which engages upon rotation of the latch member (21) with a first extension element slide surface (39). As to the embodiment of the invention shown in FIGS. 2-4, the first projection element slide surface (38) and the first extension element slide surface (39) each provide and in part or in whole a rectangular surface which engage and slide upon each other as the lid (5) travels away from the closed condition (6). The lid (5) can travel away from the closed condition (6) in the path defined by the hinged coupling (52) to a lesser or greater amount travel without releasing engagement of the first projection element slide surface (38) with the first extension element slide surface (39) depending upon the distance of slidable engagement (53) afforded by the first projection element slide surface (38) and the first extension element slide surface (39) such distance of slidable engagement made lesser or greater by varying the configuration of each of the first projection element slide surface (38) or the first extension element slide surface (39), or both. One embodiment of the projection element slide surface (39) suitable for use with the invention provides slidable engagement of the first extension element slide surface (39) on the first projection element slide surface (38) a distance of between about one-sixteenth to about one-quarter of an inch, although the invention is not so limited.

As shown primarily in FIG. 3, the second portion (26) of the latch member (21) can provide a latch element (27) which further provides a latch element slide surface (40) and the second extension element (29) can further provide a second extension element slide surface (41) which slidably engage when the latch member (21) has a location engaged with the stop (36) as the lid (5) travels toward the second occurrence of the closed condition (6). Upon engagement of the second extension element slide surface (41) with the latch element slide surface (40), additional travel of the lid (5) toward the closed condition (6) forcibly urges the latch member (21) a distance in opposed directional rotation (42) sufficient to allow the lid (5) to travel to the closed condition (6) and the latch member (21) to travel in directional rotation (25) to engage the stop element (36) in locked engagement (11) of the latch element (27) with the second extension element (29)(see FIG. 4 for example).

Again referring primarily to FIGS. 2-4, an embodiment of the inventive self locking enclosure (1), can further include a lock (43) coupled to the first portion (23) of the latch member (21)(whether directly or indirectly by linkage elements) having a configuration which operates to rotate said second portion (26) of said latch member (21) in an opposite directional rotation (42) to release locked engagement (11) of said latch member (21) and said second extension element (29). The term lock (43) broadly encompasses a device or a portion thereof accessible to a person (2) when the lid (5) is in the closed condition (6) and the latch element (21) and the second extension element (29) are in locked engagement (11) and the person can operate the accessible device or a portion thereof to disengage the latch element (27) from the second extension element (29). The lock (43) may further include a security element (45) which requires use of a matched key (46) or matched combination or other matched signal element which must be engaged, performed, or utilized with the lock (43) to allow the lock (43) to operate as above-described. The lock (43) can be operated manually by the person (2) or can be self operating in the case of a motorized lock.

As to a particular embodiment of the lock (43) shown by FIGS. 2-8, a security element (45) which allows an insertable key (46) to engage with the portion of the lock (47) accessible from outside the container (4). By inserting the key (46) into the security element (45) of the lock (43), the key (46) can be turned in the lock (43) to generate a corresponding rotation of a lock arm (48). The lock arm (48) can be pivotally coupled (49) directly, or indirectly by a latch member linkage element (50), to the first portion (23) of the latch member (21). Rotation of the key (46) in the lock (43) generates a corresponding rotation of the lock arm (48) which generates opposite directional rotation (42) of the latch member (21) about the pivot element (22) to release locked engagement (11) of the latch element (27) with the second extension element (29) upon a second occurrence of the lid (5) in the closed condition (6). By releasing locked engagement (11) of the latch element (27) with the second extension element (29), the lid (5) can travel in the second occurrence of the open condition (7).

As to certain embodiments of the self locking enclosure (1), the first extension element (34) can further include a first extension pivot element (51) about which said first extension element (34) rotates. As to these embodiments of the invention, the lock (43) can operate to generate sufficient opposite directional rotation (42) of the latch member (21) to engage the projection element (28) with the first extension element (34) and generate sufficient rotation of the first extension element (34) about the first extension pivot element (51) to allow the projection element (28) sufficient opposite directional rotation (42) to disengage from the first extension element (34). The first projection element slide surface (38) can be subsequently engaged with the first extension element slide surface (39) by directional rotation (25) of the latch member (21).

Figure 5:
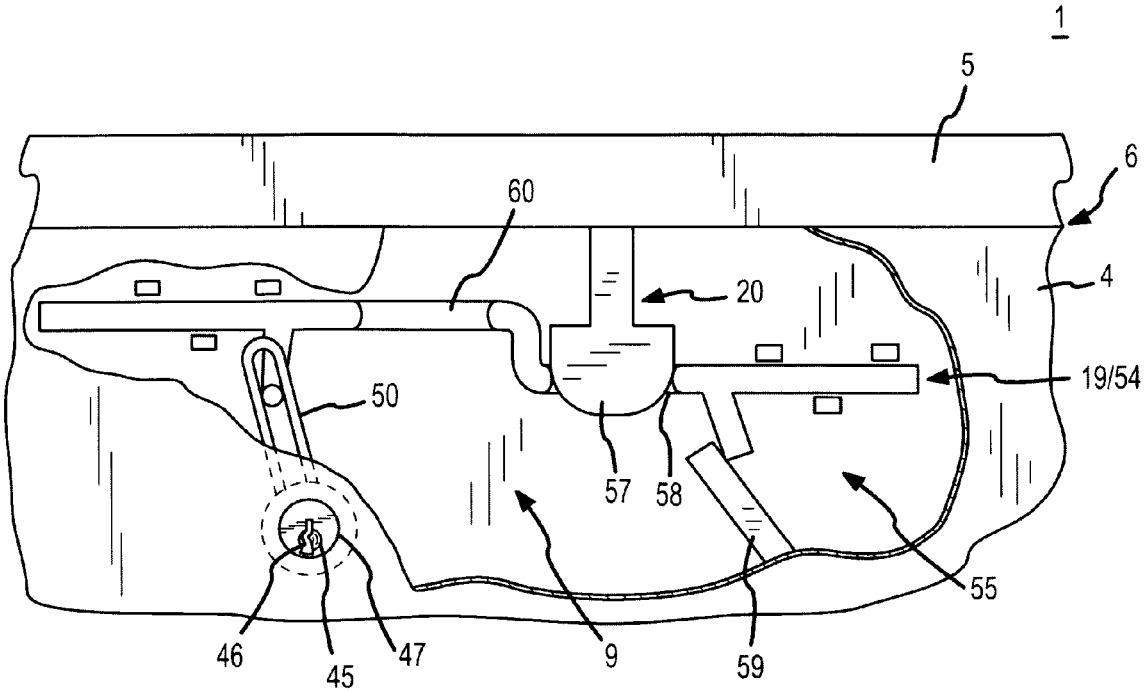
FIG. 5 is a front cutaway view of an embodiment of the self-locking enclosure with an embodiment of the latch positioned in the first occurrence of the lid in the closed condition.
Figure 6:
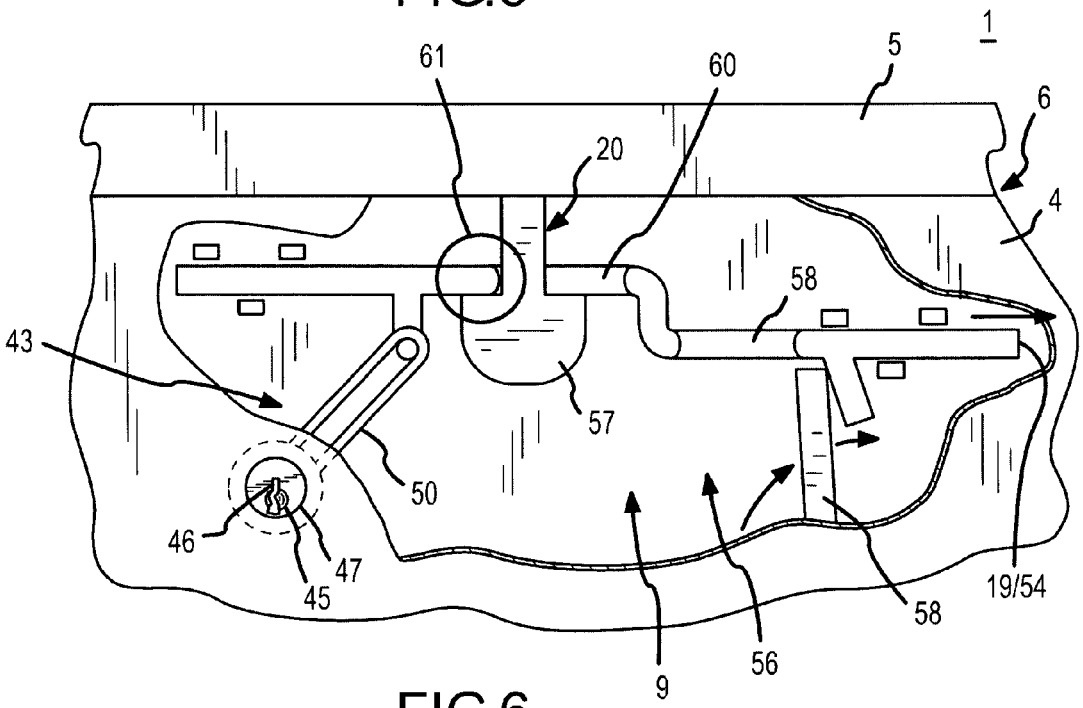
FIG. 6 is a front cutaway view of an embodiment of the self-locking enclosure with an embodiment of the latch positioned upon subsequent travel of the lid to the second occurrence of the lid in the closed condition.

Now referring primarily to FIGS. 5 and 6, an alternate embodiment of the inventive self-locking enclosure (1) can include an alternate embodiment of the latch (9) which includes a first latch part (19) comprising a slide member (54) which sidles between a first slide position (55)(shown in FIG. 5) and a second slide position (56). In the first occurrence of the closed condition (6) of the lid (5), the slide member (54) can be located in the first slide position (55) with the second latch part (20) comprising a catch element (57) inserted a sufficient distance into a first slide member recess element (58) to establish the first occurrence of the closed condition (6) of the lid (5) the slide member (54) in the first slide position (55) by nonlocking engagement of a portion of the slide member (54) with the catch element (56). The lid (5) can subsequently travel toward the open condition (7)(as shown by FIG. 3) to disengage the portion of the slide member (54) from the catch element (57). A slide generation element (59) such as the flat spring shown can operate to forcibly urge the slide member (54) to the second slide position (56). In the second slide member position (56), the second occurrence of the lid (5) in the closed condition (7) allows the catch element (57) to pass through a slide member latch element (60) and allows locking engagement (61) of the slide member latch element (60) with the catch element (57). The lock (43) can be operated as above-described to establish the slide member (54) in the first slide position (55) to establish the first occurrence of the closed condition (6).

Figure 7:
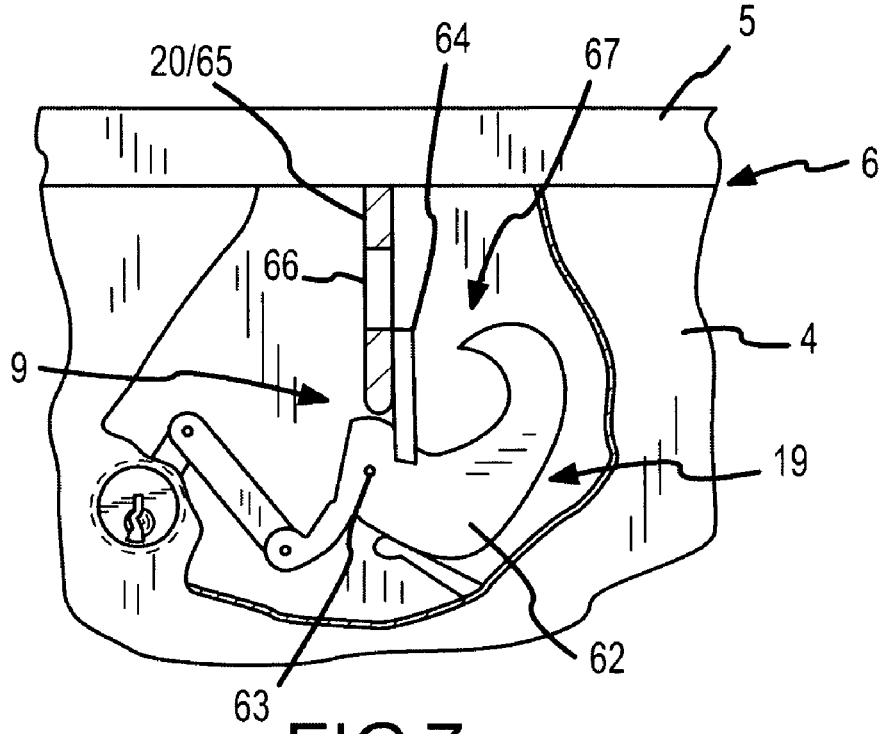
FIG. 7 is a front cutaway view of an embodiment of the self-locking enclosure with an embodiment of the latch positioned in the first occurrence of the lid in the closed condition.
Figure 8:
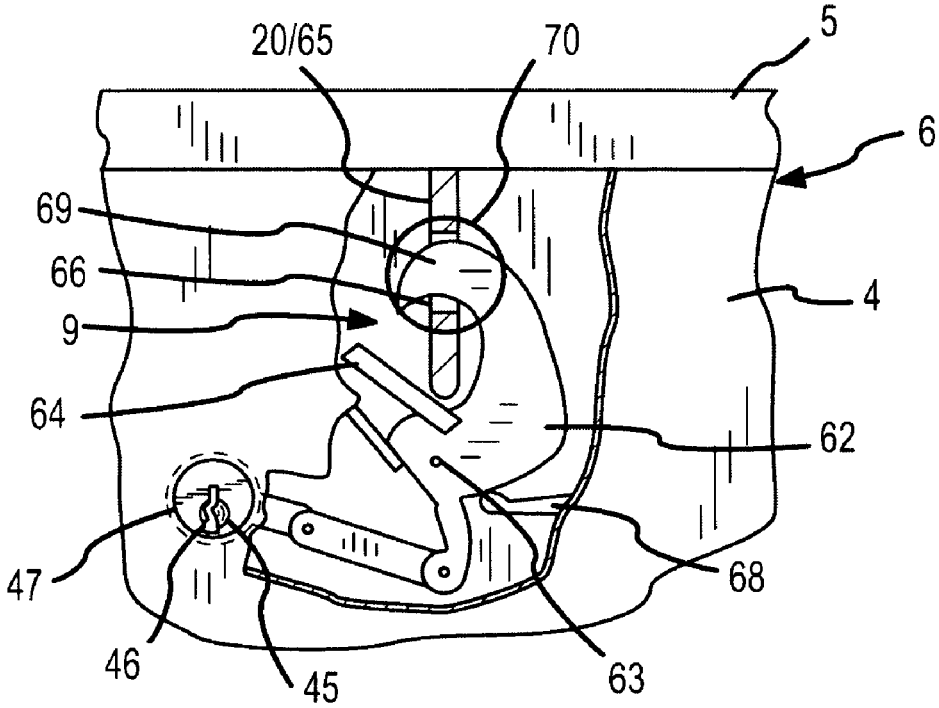
FIG. 8 is a front cutaway view of an embodiment of the self-locking enclosure with an embodiment of the latch positioned upon subsequent travel of the lid to the second occurrence of the lid in the closed condition.

Now referring primarily to FIGS. 7 and 8, an alternate embodiment of the inventive self-locking enclosure (1) can include another alternate embodiment of the latch (9) with a first latch part (19) comprising a latch member (62) pivotally coupled (63) to the container (4). In the first occurrence of the closed condition (6), a latch member stop (64) engages the second latch part (20) which comprises a latch extension (65) having a latch extension aperture (66) which establishes the latch member in the first latch position (67)(shown in FIG. 7). Upon travel of the lid (5) toward the open condition (7) (shown in FIG. 3) the rotation generation element (68) forcibly urges rotation of the latch member to the second latch position (69)(shown in FIG. 8). The second occurrence of the closed condition (6) shown by FIG. 8, allows the latch element (69) to pass into the latch extension aperture (66) and to provide locking engagement (70). The lock (43) can be operated as above-described to establish the slide member (54) in the first slide position (55) to establish the first occurrence of the closed condition (6).

As can be easily understood from the foregoing, the basic concepts of the present invention may be embodied in a variety of ways. The invention involves numerous and varied embodiments of a self locking enclosure and methods of making and using such self locking enclosure.

As such, the particular embodiments or elements of the invention disclosed by the description or shown in the figures accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "lock" should be understood to encompass disclosure of the act of "locking"—whether explicitly discussed or not—and, conversely, were there effectively disclosure of the act of "locking", such a disclosure should be understood to encompass disclosure of a "lock" and even a "means for locking." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

Thus, the applicant(s) should be understood to claim at least: i) each of the self locking enclosures herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Further, the claims set forth below are intended describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. A lock box, comprising:

a. a container;

b. a lid hingedly coupled to said container, wherein said lid operates between a closed condition and an open condition;

c. a latch having a first latch part coupled to said container and second latch part coupled to said lid, wherein said first latch part comprises a latch member which rotates about a pivot element fixedly engaged to said container, and wherein a first portion of said latch member responds to a latch member rotation generation element which generates directional rotation of a second portion of said latch member about said pivot element, and wherein said second portion of said latch member provides a latch element and a projection element, and wherein said second latch part comprises a first extension element which extends outwardly from said lid and a second extension element which extends outwardly from said lid, and wherein said first extension element and said projection element have a configuration capable of engagement upon directional rotation of said latch member about said pivot element upon a first occurrence of said lid in said closed condition, and wherein said first extension element and said projection element correspondingly provide a first projection element slide surface and a first extension element slide surface configured to provide a distance of slidable engagement upon operation of said lid element toward said open condition sufficient to avoid locked engagement of said latch element with said second extension element upon disengagement of said first projection element slide surface from said first extension element slide surface which allows further directional rotation of said latch member about said pivot element to engage a stop element, and wherein said second extension element provides a second extension element slide surface and said latch element provides a latch element slide surface which slidely engage upon operation of said lid toward said closed condition to generate rotation of said latch member in said opposite directional rotation sufficient to allow locked engagement of said latch element and said second extension element upon a second occurrence of said lid in said closed condition; and d. a lock coupled to said first portion of said latch member having a configuration which operates to rotate said second portion of said latch member in said opposite directional rotation to release locked engagement of said latch member and said second extension element.

2. A lock box as described in claim 1, further comprising a first extension pivot element about which said first extension element rotates.

3. A lock box as described in claim 2, further comprising a second projection element slide surface coupled to said projection element which engages a second first extension slide surface coupled to said first extension element to generate rotation of said first extension element about said first extension pivot element to allow sufficient opposed directional rotation of said latch member to allow engagement of said first extension element slide surface with said first projection element slide surface upon subsequent occurrence of directional rotation of said latch member.

4. A lock box as described in claim 3, further comprising a first extension element rotation generation element which operates to directionally rotate said first extension element to engage a first extension element stop.

5. A lock box as described in claim 4, where in said lock coupled to said second portion of said latch member having a configuration which operates to rotate said second portion of said latch member in an opposite directional rotation to release locked engagement of said latch member and said second extension element has a configuration which comprises:

a. a lock arm coupled to said lock which rotates in response to operation of said lock;

b. a latch member drive element pivotally coupled at a first end to the second portion of said latch member and pivotally coupled at a second end to said lock arm, whereby rotation of said lock arm generates rotation of said latch member about said pivot element.

6. A lock box as described in claim 5, wherein said latch member rotation generation element comprises a coil spring have a first end connect to said first portion of said latch member and a second end fixedly coupled to said container.

7. A lock box as described in claim 6, wherein said latch member rotation generation element comprises a resiliently flexible arm member which extends from said stop element to engage said first portion of said latch member.

8. A method of locking a box, comprising the steps of:

a. providing a container;

b. hingedly coupling a lid to said container;

c. operating said lid between an open condition and a closed condition to establish a first occurrence of said closed condition of said lid;

d. generating directional rotation of a latch member about a pivot element fixedly engaged to said container toward a stop element;

e. engaging a projection element of said latch member with a first extension element extending from said lid to stop directional rotation of said latch member about said pivot element;

f. operating said lid between said closed condition and toward said open condition to slidely disengage said projection element of said latch member from said first extension element, wherein sliding disengagement occurs over a distance sufficient to delay directional rotation toward said stop element to avoid locked engagement of said latch element with a second extension element;

g. generating directional rotation of said latch member about said pivot element to engage a stop element;

h. operating said lid between said open condition and said closed condition to establish a second occurrence of said closed condition of said lid thereby slidely engaging a second extension element slide surface with a latch element slide surface to generate opposed directional rotation of said latch member sufficient to allow locking engagement of said latch element of said latch member with a second extension element extending from said lid; and j. operating a lock which generates opposed directional rotation of said latch member about said pivot element to release locked engagement of said latch element with said second extension element.

9. A method of locking a box as described in claim 8, where said step of operating a lock further comprises the steps of:

a. rotating a lock arm;

b. generating travel in a latch member drive element pivotally coupled at a first end to said lock arm and pivotally coupled at a second end to a second portion of said latch member;

c. generating opposite directional rotation of said latch member to release locked engagement of said latch element of said latch member with said second extension element.

10. A method of locking a box as described in claim 9, further comprising the step of generating rotation of said first extension element coupled to said lid about a pivot element fixed coupled to said lid.

11. A method of locking a box as described in claim 10, further comprising the step of slidely engaging a first extension element slide surface with a latch element slide surface to generate rotation of said first extension element about said pivot element fixedly coupled to said lid sufficient to allow engagement of said latch element of said latch member with said first extension element to stop directional rotation of said latch member about said pivot fixedly coupled to said container.

* * * * *